US006832946B2

(12) United States Patent
Hatano

(10) Patent No.: US 6,832,946 B2
(45) Date of Patent: Dec. 21, 2004

(54) LENS GRINDING METHOD AND LENS GRINDING APPARATUS

(75) Inventor: Yoshiyuki Hatano, Tokyo (JP)

(73) Assignee: Kabushiki Kaisha TOPCON, Tokyo (JP)

( * ) Notice: Subject to any disclaimer, the term of this patent is extended or adjusted under 35 U.S.C. 154(b) by 291 days.

(21) Appl. No.: 09/977,632

(22) Filed: Oct. 15, 2001

(65) Prior Publication Data

US 2002/0086613 A1 Jul. 4, 2002

(30) Foreign Application Priority Data

Oct. 17, 2000 (JP) ..... 2000-317056

(51) Int. Cl.[7] ..... B24B 49/00
(52) U.S. Cl. ..... 451/5; 451/43
(58) Field of Search ..... 451/5, 8, 43, 42, 451/44, 255, 256

(56) References Cited

U.S. PATENT DOCUMENTS 5,148,637 A * 9/1992 Byron ..... 451/5
5,775,973 A * 7/1998 Watanabe ..... 451/5
6,050,877 A * 4/2000 Shibata et al. ..... 451/5
6,478,657 B1 * 11/2002 Shibata ..... 451/43

FOREIGN PATENT DOCUMENTS

JP 08-294855 11/1996 ..... B24B/9/14
JP 09-277148 10/1997 ..... B24B/9/14

* cited by examiner

*Primary Examiner*—Robert A. Rose
(74) *Attorney, Agent, or Firm*—Chapman and Cutler LLP

(57) ABSTRACT

A lens grinding method and apparatus for changing a lens rotation speed when grinding a spectacle lens by using spectacle frame lens shape information, spectacle lens information such as spectacle lens material, and various spectacle processing information required for processing a spectacle lens.

4 Claims, 10 Drawing Sheets

LENS GRINDING METHOD AND LENS GRINDING APPARATUS

BACKGROUND OF THE INVENTION

1. Field of the Invention

The present invention relates to a lens grinding method and a lens grinding apparatus for grinding a spectacle lens by adjusting a distance between a lens rotation shaft for sandwiching and rotating a spectacle lens and a grindstone rotation shaft for grinding a spectacle lens into a lens shape such as a spectacle frame and in particular, to control of rotation speed of the lens rotation shaft for rotating the spectacle lens.

2. Description of the Prior Art

In a conventional lens grinding apparatus, a carriage is mounted on the apparatus main body in such a manner that the carriage can rotate around a rear end portion to swing upward end downward, a pair of lens rotation shafts arranged at right and left on a single axis are rotatably held at shaft mounting protrusions at right and left of the carriage. One of the lens rotation shafts can be adjusted so as to proceed and recess with respect to the other lens rotation shaft. Rotation drive means is provided for the lens rotation shafts and raising/lowering means is provided for swinging the lens rotation shaft and the carriage upward and downward A grindstone is rotatably held on the apparatus at a position below a lens arranged between the pair of lens rotation shads so as to be processes A calculation control circuit is provided for driving/controlling the rotation drive means and the raising/lowering means according to spectacle lens shape information ($\rho_{n,\ n}\angle\theta$).

This spectacle lens shape information ($\rho_{n,\ n}\angle\theta$) may include lens frame shape of a spectacle frame lens and lens model of a rimless frame. This spectacle lens shape information is normally measured by a lens frame shape measuring apparatus such as a frame reader and is transferred to a lens grinder. It should be noted that the spectacle lens shape is not a strict circle but a complicated shape consisting of a curved portion and a straight portion or an indented arc portion. The calculation control circuit of the lens grinder drives and controls the rotation drive means so as to rotate/drive the lens rotation shaft, thereby rotating the lens held on the lens rotation shaft so as to be processed. On the other hand, the calculation control circuit operate the raising/lowering means based on the spectacle lens shape information ($\rho_{n,\ n}\angle\theta$), thereby raising/lowering the carriage. With this control, a periphery of the lens to be processed is ground into a spectacle shape by the grindstone.

Here, as shown in FIG. 13A, the lowest position of the lens rotation shaft by the self-weight of the carriage is adjusted for each rotation angle $_n\Delta\theta$ by the raising/lowing means, thereby adjusting a distance $L_n$ between the lens rotation shaft line $O_1$ at the rotation angle $_n\Delta\theta$ and the rotation center (rotation shaft line) $O_2$ of the grindstone Q, so that the lens LE to be processed is ground into a spectacle lens shape.

In this grinding process, at the maximum radius value $\rho_{max}$ of the spectacle lens shape information ($\rho_{n,\ n}\angle\theta$), the lens LE to be processed is in contact with the grindstone Q on a virtual straight line S connecting the lens rotation center $O_1$ and the rotation center $O_2$ of the grindstone Q.

However, as grinding of the periphery of the lens to be processed proceeds, the lens LE is scarcely brought into contact with the grindstone Q on the aforementioned virtual straight line S. Especially when finishing grinding (polishing) is performed by the finishing grindstone (grindstone Q), the periphery of the lens LE is already in an approximately spectacle lens shape and accordingly, as shown in FIG. 13B, the straight line portion La and the indented arc portion (not depicted) of the lens LE are brought into contact with the grindstone Q at a position P on the virtual straight line S only via their intermediate position and the other portions are brought into contact at a position P shifted in the circumferential direction from the virtual straight line S.

That is, in case of an acute angle portion Lb of the periphery of the lens LE, change of fine rotation angle of the lens to be processed does not change significantly the shift amount of the contact position of the periphery of the lens LE with the grindstone Q. However, at the straight line portion La and the indented portion, sight rotation of the lens LE causes a great shift amount of the contact position of the periphery of the lens LE with the grindstone Q.

Accordingly, when a lens is rotated at a constant speed as in the prior art, the contact time between the grindstone Q and the lens LE differs according to the spectacle shape. That is, the contact time between the acute angle portion Lb and the grindstone Q becomes long while the contact time at the straight line portion La becomes short Accordingly in the conventional grinding method, even when an accurate spectacle lens shape information ($\rho_{n,\ n}\angle\theta$) is obtained, it has been impossible to obtain an accurate spectacle lens shape based on this spectacle lens shape information ($\rho_{n,\ n}\angle\theta$) because of the difference in the grinding condition (state) at the periphery That is, in case the lens shape data is circular, even when a lens to be processed has become almost a lens shape by grinding, the lens is still circular. For this, when the lens to be ground by the grindstone is lowered, the lens and the grindstone are in contact with each other at a constant speed at any portions of the lens and the grindstone. However, when the lens shape information is rectangular, as the lens to be processed approaches a lens shape, the lens becomes more and more rectangular. In the lens which has become almost rectangular; when_an apex defined by two sides of the rectangular shape is brought into contact with the grindstone, the contact time on the grindstone becomes longer. On the other hand, when a center portion of each of the sides of the rectangular lens shape is considered, the entire side of the lens to be ground according to the lens shape data is in contact with the periphery of the grindstone while rotating along the grindstone. Thus the lens is in contact with only one point on the grindstone and the contact time becomes very short To work around this, Japanese Patent Laid-open No. Hei 09-277148 discloses a lens grinding method and a lens grinding apparatus in which a contact time of a lens to be processed, with a grindstone is adjusted according to a spectacle shape by considering a shift amount of the contact position between the lens and the grindstone in a peripheral direction, thereby enabling to accurately grind a spectacle lens shape.

In this lens grinding apparatus, according to the lens shape data ($\rho_n$, $_n\angle\theta$) for processing a lens periphery measured by lens shape measuring means, a lens to be processed is rotated and simultaneously with this, advanced/recessed for each rotation angle $_n\angle\theta$ while the periphery of the lens is ground by the grindstone into a spectacle lens shape. Moreover, using the lens shape data ($\rho_{n,\ n}\angle\theta$) and the radius of curvature of the grindstone, calculation is performed to obtain a difference angle $d\theta_n$ defined by a virtual processing point at radius vector $\rho_n$ of the rotation angle ${}_n\Delta\theta$[n=0, 1, 2, 3, . . . j] and an actual contact processing point of the lens with the grindstone at rotation angle ${}_n\Delta\theta$, and the rotation angular speed of the lens is controlled according to the angle $d\theta_n$ at this rotation angle ${}_n\Delta\theta$, so that the contact time of the grindstone at the rotation angle ${}_n\Delta\theta$ is approximately constant.

In this lens grinding apparatus, correction data based on the obtained angle $d\theta_n$ is called from a correction table. This correction data and a reference rotation speed of the lens rotation shaft are used to calculate a correct a lens rotation speed to be corrected, which in turn is used for controlling the rotation speed of the lens rotation shaft (lens to be processed).

However, conventionally, it is necessary to store correction data based on the angle $d\theta_n$ for each of the lens materials in the correction table. Nowadays, various lens materials are used and it is difficult to obtain correction data for each of the lens materials to prepare a correction table.

In this correction method, $d\theta_n$ differs according to the frame shape data and accordingly, a rant requiring rotation correction and the correction amount are not constant, causing a problem that a significant time is required.

When considering a frame shape as a limited number of radius vector data items, a radius vector of the lens points to a center of the grindstone. To indicate this direction, an angle with respect to a rotation reference position when the lens shape is represented in spherical coordinates is called a rotation angle, and an angle dewed by a radius vector of the rotation angle when the lens shape in contact with the grindstone represented in spherical coordinates and a radius vector of the contact point of the lens with the grindstone is called a contact angle. The total of the rotation angle and the contact angle will be referred to as a processing angle. Here, consideration is taken for a case when an apex of an approximately rectangular lens is in contact and a case when a side of the approximately rectangular lens is in contact. When the apex is in contact, the contact angle does not change while the rotation angle greatly changes. As a result, as the rotation angle changes, the processing angle greatly changes its sign from positive to negative together with a great change of its absolute value. In contrast to this, when the side is in contact, a change of the contact angle is greater than a change of the rotation angle. It looks like that the contact angle, sandwiching the middle point of the side of the rectangular lens, outruns the processing angle. In the same way as this, the processing angle becomes 0 at the middle point of the side, changes its s from negative to positive, and its absolute value is also greatly changed.

Thus, in the conventional correction time based on the processing angle, as the processing angle increases, its time is also increased. However, as has been described above, at the different processing conditions at the apex and the side, the processing angle changes its sign passing 0. That is, at the apex and at the middle point of the side where the speed should be different, actually the velocities coincide. Accordingly, it has been impossible to obtain a constant contact time at different points.

SUMMARY OF THE INVENTION

It is therefore an object of the present invention to provide a lens grinding method and an apparatus for the same capable of giving a rotation speed stabilizing the contact time at different points and changing the stability of the rotation speed at different points according to the material and the processing conditions.

In order to achieve the aforementioned object, the lens grinding method according to the present invention changes a lens rotation speed when grinding a spectacle lens by using spectacle frame lens shape information, spectacle lens information such as spectacle lens material, and various spectacle processing information required for processing a spectacle lens.

According to another aspect of the present invention, a predetermined angle for the rotation reference position when the spectacle frame lens shape is expressed in spherical coordinates is referred to as a rotation angle while an angle for the rotation reference position when the lens shape in contact with the grindstone is expressed in spherical coordinates is referred to as a contact angle and calculation is performed to obtain a rotation angle change of the lens rotation shaft holding the spectacle lens per a predetermined time as a rotation angular speed and a contact angle change per a predetermined time as a contact angular speed, so that the rotation speed of the lens rotation shaft is controlled by the speed obtained by combining the speed component in which the rotation angle rotates at a constant speed and the speed component in which the contact angle rotates at a constant speed.

According to yet another aspect of the present invention, a predetermined angle for the rotation reference position when the spectacle frame lens shape is expressed in spherical coordinates is referred to as a rotation angle while an angle for the rotation reference position when the lens shape in contact with the grindstone is expressed in spherical coordinates is referred to as a contact angle and calculation is performed to obtain a rotation angle change of the lens rotation shaft holding the spectacle lens per a predetermined time as a rotation angular speed and a contact angle change per a predetermined time as a contact angular speed, so that the rotation speed of the lens rotation shaft can change with an arbitrary combination ratio of the speed component in which the rotation angle rotates at a constant speed and the speed component in which the contact angle rotates at a constant speed.

According to still another aspect of the present invention, there is provided a lens grinding apparatus comprising: a lens rotation shaft for sandwiching and rotating a spectacle lens; drive means for driving the lens rotation shaft; a grindstone for grinding a spectacle lens; shaft-to-shaft distance adjusting means for controlling a distance between a lens rotation shaft and a grindstone; and calculation control means which operates in such a manner that a predetermined angle for the rotation reference position when the spectacle frame lens shape is expressed in spherical coordinates is referred to as a rotation angle while an angle for the rotation reference position when the lens shape in contact with the grindstone is expressed in spherical coordinates is referred to as a contact angle and calculation is performed to obtain a rotation angle change of the lens rotation shaft holding the spectacle lens per a predetermined time as a rotation angular speed and a contact angle change per a predetermined time as a contact angular speed, so that the rotation speed of the lens rotation shaft is controlled by the speed obtained by combining the speed component in which the rotation angle rotates at a constant speed and the speed component in which the contact angle rotates at a constant speed.

According to yet still another aspect of the present invention, the lens grinding apparatus comprises: a lens rotation shaft for sandwiching and rotating a spectacle lens; drive means for driving the lens rotation shaft; a grindstone for grinding a spectacle lens; shaft-to-shaft distance adjusting means for controlling a distance between a lens rotation shaft and a grindstone; and calculation control means which operates in such a manner that a predetermined angle for the rotation reference position when the spectacle frame lens shape is expressed in spherical coordinates is referred to as a rotation angle while an angle for the rotation reference position when the lens shape in contact with the grindstone is expressed in spherical coordinates is referred to as a contact angle and calculation is performed to obtain a rotation angle change of the lens rotation shaft holding the spectacle lens per a predetermined time as a rotation angular speed and a contact angle change per a predetermined time as a contact angular speed, so that the rotation speed of the lens rotation shaft can change with an arbitrary combination ratio of the speed component in which the rotation angle rotates at a constant speed and the speed component in which the contact angle rotates at a constant speed.

BRIEF DESCRIPTION OF THE ATTACHED DRAWINGS

FIG. 1(A) explains a control circuit of a lens grinding apparatus according to the present invention.

FIG. 1(B) explains another example of shape measuring means shown in FIG. 1A.

Figure 11:
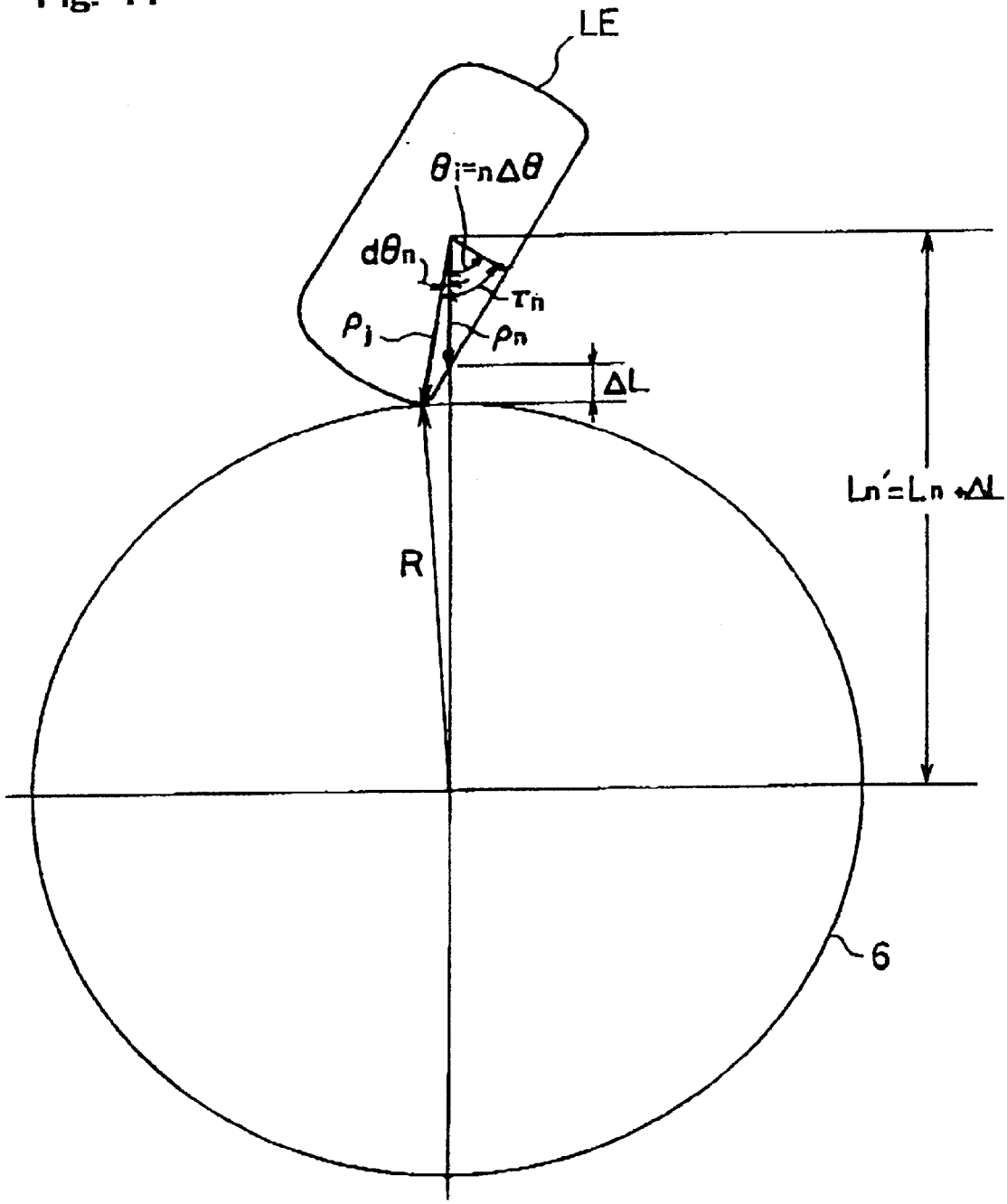

FIG. 11 explains the function obtained by the present invention.

Figure 12:
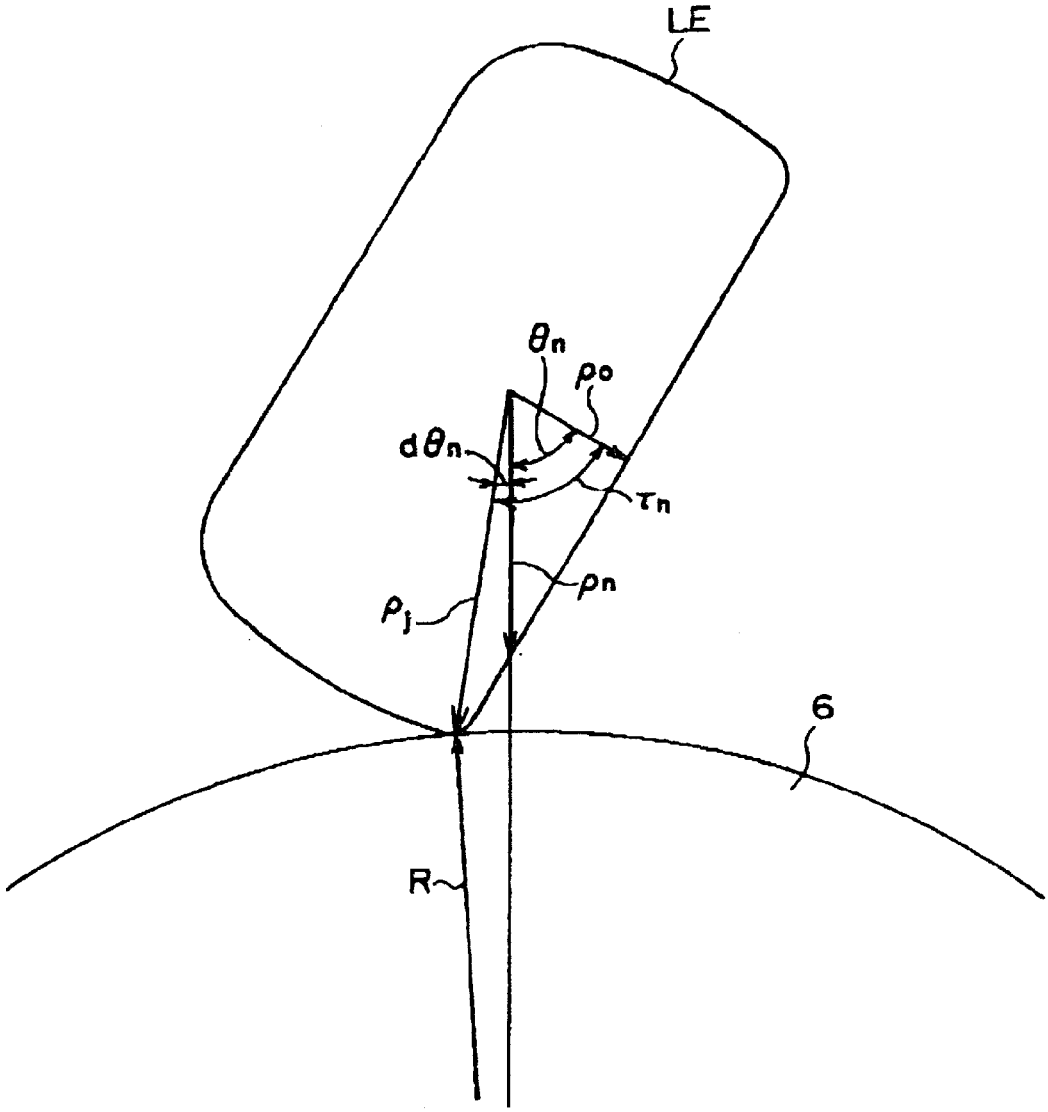

FIG. 12 is an enlarged view of an essential portion of FIG. 12.

Figure 13A:
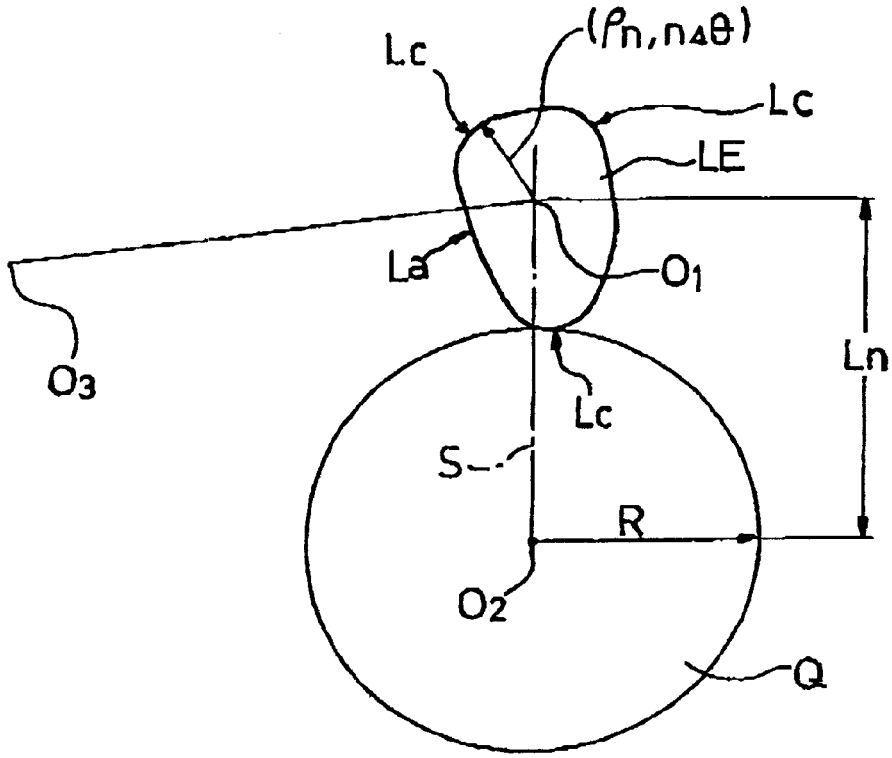

FIG. 13(A) explains a conventional lens grinding.

Figure 13B:
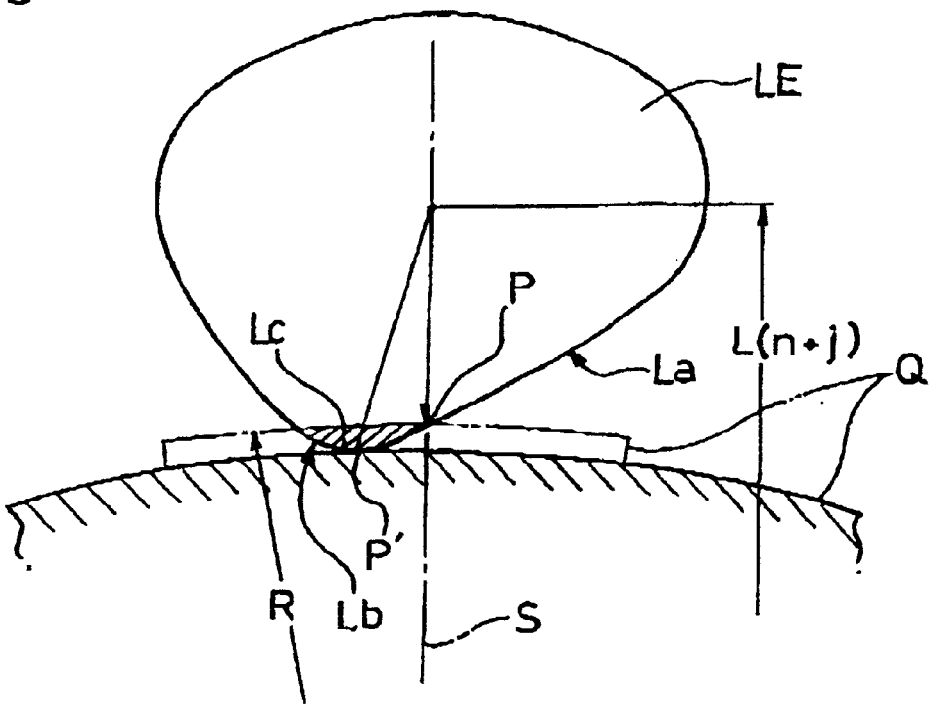

FIG. 13(B) is an enlarged view of the lens of FIG. 13A at a rotated position.

DESCRIPTION OF THE PREFERRED EMBODIMENTS

Description will now be directed to embodiments of the present invention.

[Outline]

The present invention is basically configured as follows.

When a limited number of radius vector data items of the frame shape are available, a radius vector of the lens is oriented to the center of the grindstone.

When considering a frame shape as a limited number of radius vector data items, a radius vector of the lens points to a center of the grindstone. To indicate this direction, an angle with respect to a rotation reference position when the lens shape is represented in spherical coordinates is called a rotation angle, and an angle defied by a radius vector of the rotation angle when the lens shape in contact with the grindstone represented in spherical coordinates and a radius vector of the contact point of the lens with the grindstone is called a contact angle. The total of the rotation angle and the contact angle will be referred to as a processing angle. Here, consideration is taken for a case when an apex of an approximately rectangular lens is in contact and a case when a side of the approximately rectangular lens is in contact. When the apex is in contact, the contact angle does not change while the rotation angle greatly changes. As a result, as the rotation angle changes, the processing angle changes. In contrast to this, when the side is in contact, a change of the contact angle is greater than a change of the rotation angle. It looks like that the contact angle, sandwiching the middle point of the side, outruns the processing angle. In the same way as this, the processing angle becomes 0 at the middle point of the side, and changes its direction between positive and negative direction.

The rotation angle represents rotation of the lens being processed even when the entire spatial coordinates including the grindstone are considered. While the rotation angle changes by a unit angle, there is a portion where the contact angle does not change and a portion where the contact angle greatly changes. The portion where the contact angle does not change even when the rotation angle changes means a portion where the contact position with the grindstone does not change even when the lens is rotated. As a result, the same position is ground for a long time, For such a portion, the rotation speed should be increased. On the contrary, for the portion where the contact angle is greatly changed against the rotation angle, the contact position of the lens with the grindstone is shifted and grinding cannot proceed sufficiently.

Conventionally, for obtaining control data (direction), a so-called ρL conversion hag been used. In this ρL conversion, L data (X direction) is obtained according to the rotation angle. In the process to calculate the L data, the processing angle and the ρ data at that processing angle are used. Since the contact angle is at a position apart from the processing angle against the rotation angle, its change also shows the change of the contact angle.

As a method for realizing this idea, change of the rotation angle and change of the contact angle at different portions are taken into consideration so as to determine a ratio, i.e., a contact angle ratio=[contact angle change]/[rotation angle change]. When the inverse number of this ratio is proportional to the rotation speed, the contact time is constant at any of the portions. Actually, however, there is a portion where the contact angle change is almost zero and a portion where the contact angle change is very large, Accordingly, the contact angle ration changes greatly. This inverse number changes approximately from 0 to infinity. That is, it is impossible to obtain a complete proportion To cope with this, the rotation speed at each of the portions is determined by a composition of a portion for stabilizing the contact and a portion for simple rotation.

Rotation speed=Contact stabilizing portion+Simple rotation portion

By changing this composition ratio according to various processing conditions (materials and processing steps), it becomes possible to change the lens rotation speed more actively.

[Configuration]

The aforementioned will be detailed with reference to the drawings.

<Grinding Block>

Figure 2:
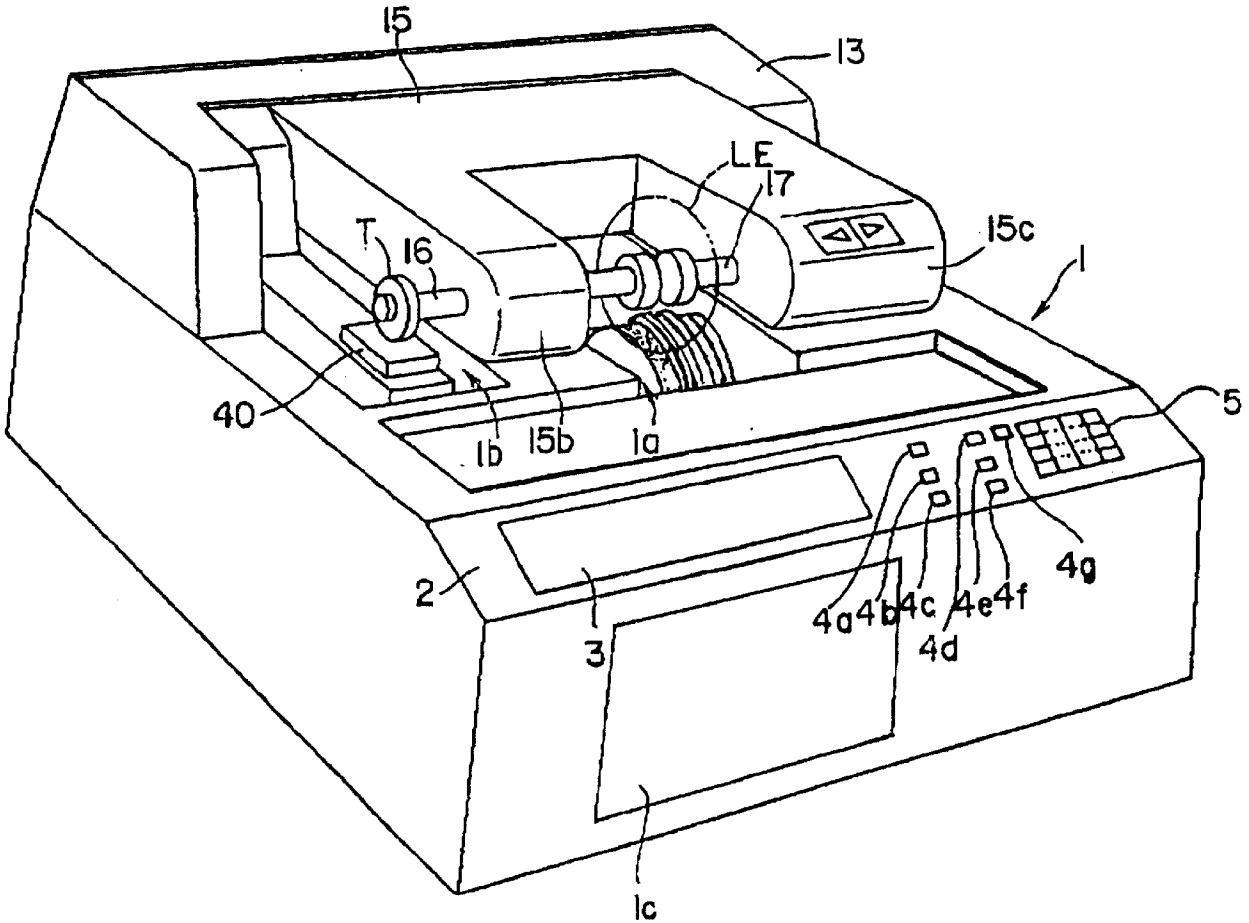
FIG. 2 is a perspective view of a spectacle grinder having the control circuit shown in FIG. 1.

In FIG. 2, the reference symbol 1 denotes a frame-shaped main body of a lens periphery processing apparatus (lens grinder); 2, an inclined surface provided on the upper front of the main body 1; 3, a liquid crystal display block arranged at the left half of the inclined surface 2; 4, a keyboard block arranged at the right half of the inclined surface 2.

This keyboard 4 has a switch 4*a* for FPD input mode, a switch 4*b* for PD input mode, a switch 4*c* for bridge width input mode, a switch 4*d* for selecting a lens material, a switch 4*e* for switching mode, a switch 4*f* for starting measurement, a switch 4*g* for processing, and a ten-key block 5.

Moreover, indentations 1*a* and 1*b* are provided at the center portion and the left portion of the main body 1. A grindstone 6 (grinding wheel) is rotatably held at the indentation 1*a* on the main body 1. The grindstone 6 includes a rough grindstone 6*a*, a V-shape grindstone (V-shaped protrusion grinding stone), and a finishing grindstone (grindstone made from fine particles) 6*c* and rotated/driven by a motor 7 shown in FIG. 1.

Figure 3:
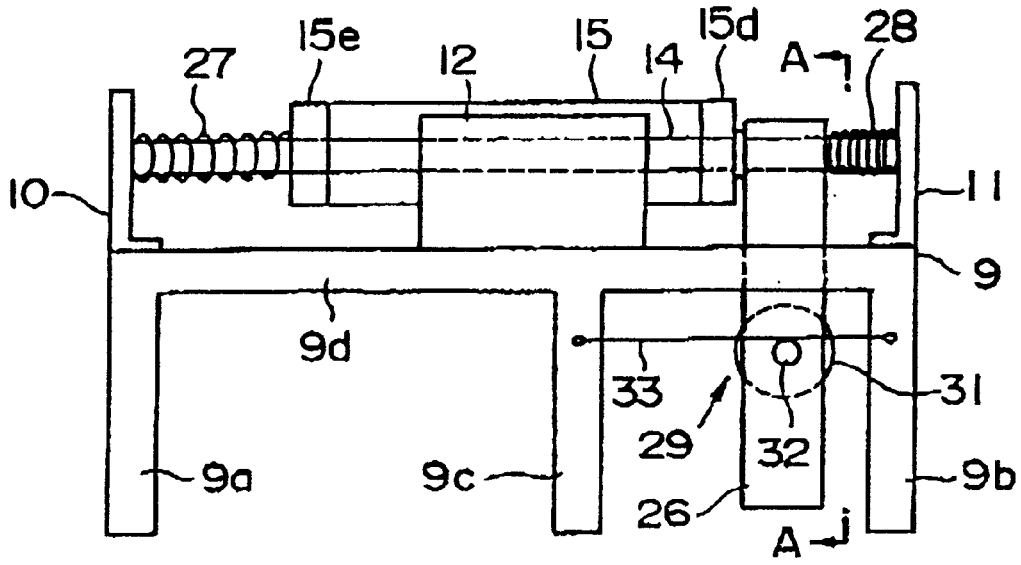
FIG. 3 shows a mounting portion of a carriage shown in FIG. 1.

As shown in FIG. 3, in tie main body 1, a support table 9 is fired for supporting a carriage. This support table 9 includes a left leg 9*a* and a right leg 9*b*, an intermediate leg 9*c* arranged between the legs 9*a* and 9*b* and nearer to the leg 9*b*, and a mounting plate 9*d* connecting the tops of the legs 9*a* to 9*c*.

Shaft mounting brackets 10 and 11 protrude from both sides of the mounting plate 9*i*. A shaft supporting protrusion 12 protrudes from an intermediate portion of the mounting plate 9*d*. The brackets 10 and 11 and the shaft supporting protrusion 12 are covered by a U-shaped cover 13 shown in FIG. 2. A support shaft 14 thrusting through the shaft support protrusion 12 has two ends fixed to the brackets 10 and 11.

<Carriage>

The carriage 15 is arranged on the main body 1. This carriage 15 includes a carriage main body 15*a*, arms 15*b* and 15*c* arranged parallel to each other and protruding forward from both sides of the carriage main body 15*a*, and protrusions 15*d* and 15*e* protruding backward from both sides of the carriage main body 16*a*.

The protrusions 15*d* and 15*e* are arranged so as to sandwich the shaft support protrusions 12 as show in FIG. 3 and held on the support shaft 14 in such a manner that the protrusions 15*d* and 15*e* can rotate around the support shaft 14 and in the longitudinal direction (leftward and rightward) of the support shaft 14. Thus, the front end of the carriage 15 can swing upward and downward about the support shaft 14.

A lens rotation shaft 16 is rotatably held on the arm 15*b* of the carriage 15. On the arm 16*c* of the carriage 15, a lens rotation shaft 17 arranged coaxial with the lens rotation shaft 16 is held in such a manner that the lens rotation shaft 17 can rotate and advance/retrieve with respect to the lens rotation shaft 16. A lens LE to be processed is sandwiched between opposing ends of the lens rotation shaft 16 and 17 Moreover, a disc T is detachably attached by fixing means (not depicted) to the other end of the lens rotation shaft 16. This fixing means has conventional configuration.

The lens rotation shafts 16 and 17 are rotated/driven by a shaft rotation/drive apparatus (haft rotation/drive means). The shaft rotation/drive apparatus includes a pulse motor 18 (rotation drive mean) fixed into the carriage main body 15*a* and a power transmission mechanism (power transmission means) 19 for transmitting rotation of the pulse motor 18 to the lens rotation shafts 16 and 17.

The power transmission mechanism 19 is composed of: pulleys 20, 20 mounted an the lens rotation shafts 16 and 17, respectively; a rotation shaft 21 rotatably held on the carriage main body 15*a*; pulleys 22, 22 fixed to two ends of the rotation shaft 21, respectively; a timing belt 23 suspended over the pulleys 20 and 22; a gear 24 fixed to the rotation shaft 21; a pinion 25 for output of the pulse motor 18; and the like.

Moreover, on the support shaft 14, a rear portion of the support arm 26 arranged in the indentation 1*a* of the main body 1 is held in such a manner that it can move leftward and rightward, This support arm 26 is held on the support shaft 14 in such a manner that it can rotate against the carriage 15 and move rightward and leftward. It should be noted that the support arm 26 has an intermediate portion held via a shaft (not depicted) on the main body 1 so as to be movable rightward and leftward A spring 27 wound around the support shaft 14 is arranged between the support arm 26 and a bracket 10 while a spring 28 is arranged between the main body 1 and a bracket 11. The carriage 15 stops at a position where the spring force of the spring 27 is balanced with the spring force of the spring 28. At this stop position, the lens LE to be processed and held between the lens rotation shafts 16 and 17 is positioned on the rough grindstone 6*a*.

<Carriage Lateral Movement Means>

Figure 4:
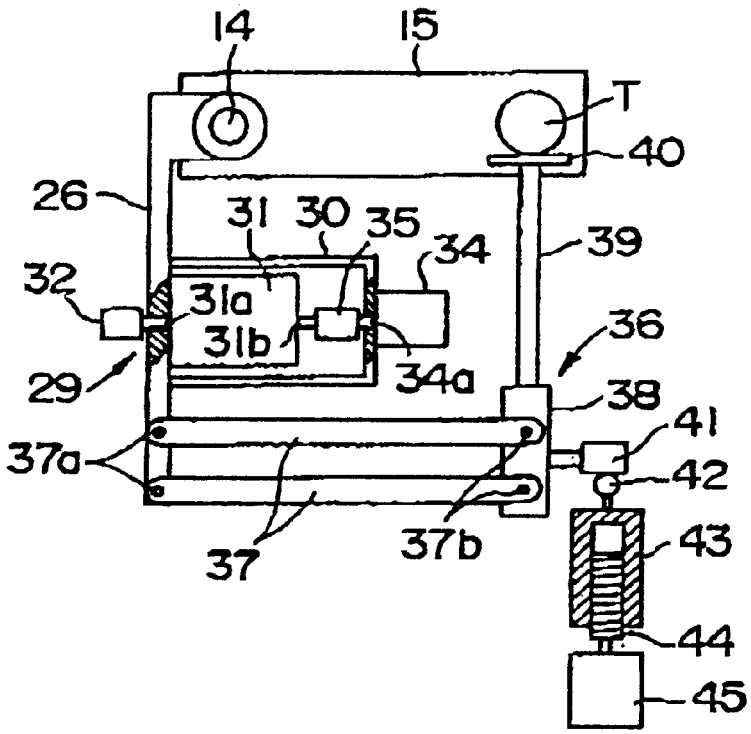
FIG. 4 is a partial cross sectional view about the line A—A in FIG. 3.
Figure 5:
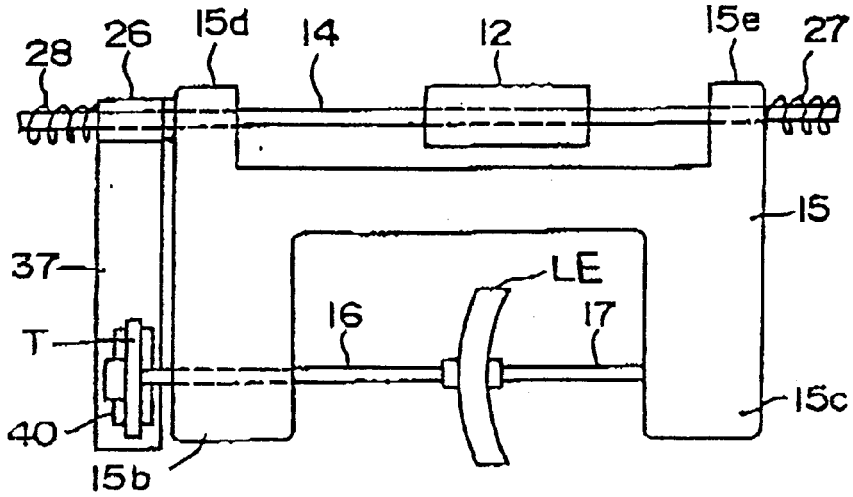
FIG. 5 is a partial plan view of the carriage shown in FIG. 1.

The carriage 15 is arranged so as to be movable rightward and leftward by the carriage lateral movement means 29 (see FIG. 3, FIG. 4 and FIG. 5).

This carriage lateral movement means 29 includes: a U-shaped bracket 30 fixed to the front surface of the support arm 26; a variable motor 31 positioned in the bracket and fixed to the front surface of the support arm 26; a pulley 52 fixed to an output shaft 31*a* thrusting through the support arm 26 of the variable motor 31; and a wire 33 having two end fixed between the legs 9*b* and 9*c* of the support table 9 and wound around the pulley 32.

Moreover, the carriage lateral movement means 29 includes a rotary encoder 34 (detection means) fixed to the bracket 30 and a coupling 35 connecting a rotation haft 34*a* of the rotary encoder 34 and an output shaft 31*b* of the variable motor 31. It should be noted that when power supply to the variable motor 31 is stopped, the output shaft 31*b* is in a state of free rotation.

<Carriage Raising/Lowering Means>

As shown in FIG. 3, below the position corresponding to the disc T, carriage raising/lowering means 36 is provided as between-shafts adjustment means.

This carriage raising/lowering means 36 includes: links 37, 37, each having a base end rotatably mounted on the support arm 26 via pivots 37*a*, 37*a* in such a manner that their free ends can move upward and downward; a link 38 rotatably mounted on the free ends of links 37, 37 via pivots 37*b*, 37*b*; a support rod 39 protruding upward from the link 38; and a sheet-shaped receiver 40 provided on the top of the support rod 39.

Moreover, the carriage raising/lowering means 36 includes: a shaft member 41 protruding forward at right angle against the support rod 39; a bearing member 42 extending in the movement direction of the carriage 15 for supporting the &haft member 41; a female screw cylinder 43 provided on the bearing member 42 and held on the main body 1 at a position (not depicted) where rotation in the circumferential direction is disabled and upward/downward movement is enabled; a male screw 44 engaged with the female screw cylinder 43; and a pulse motor 45 fixed to the main body 1 and rotating/driving the male screw 44.

<Spectacle Lens Shape Measurement Block (Spectacle Lens Shape Measurement Apparatus)>

A spectacle lens shape measurement block 46 is provided as spectacle lens shape measurement means in the apparatus main body 1. This spectacle lens shape measurement block 46 can be taken out of the apparatus main body 1 when a lid 1*c* is arranged on tie front of the apparatus main body 1 is opened.

Figures 1A, 1B:
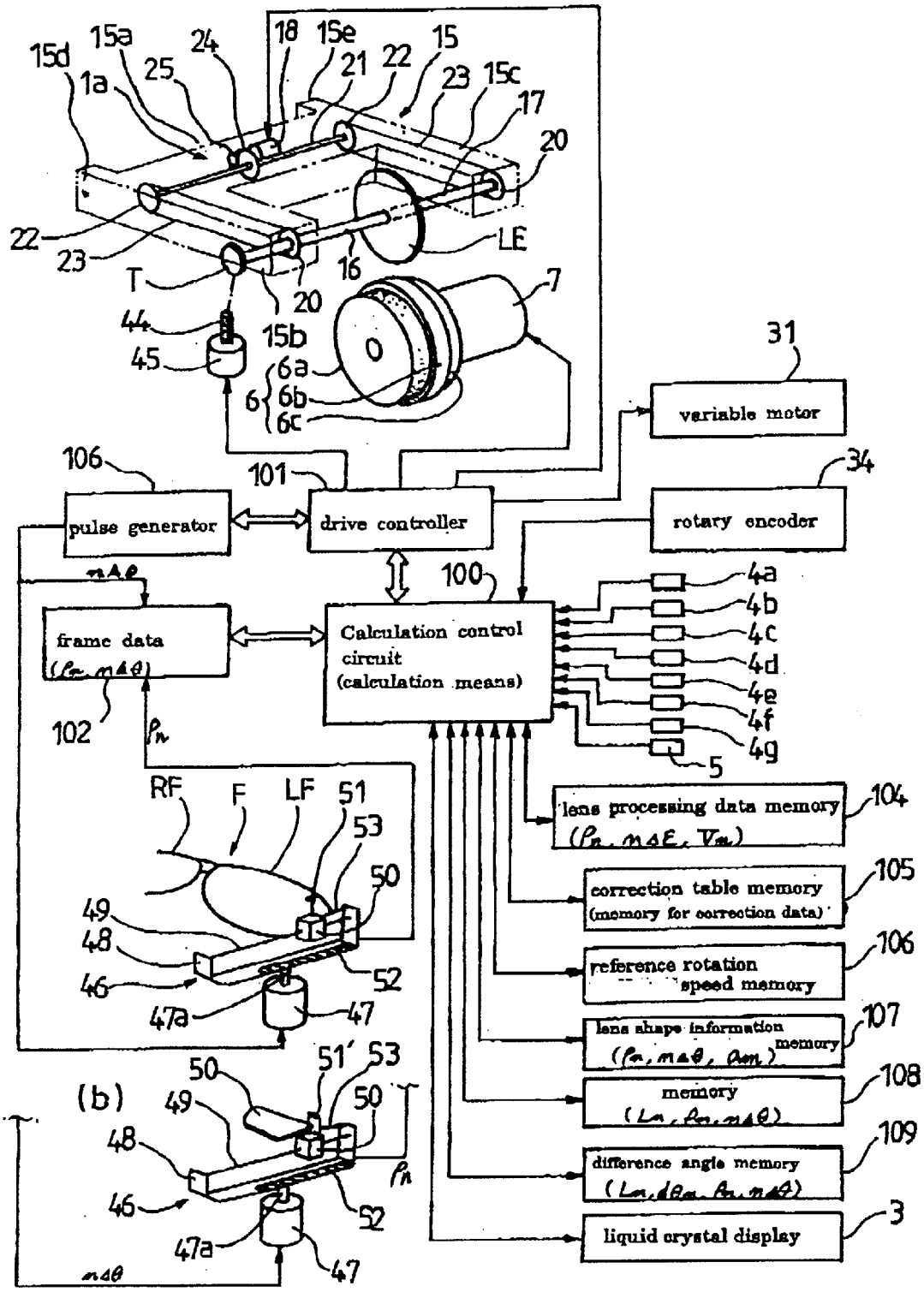

As shown in FIG. 1A, the spectacle lens shape measurement block 46 includes: a pulse motor 47, a rotation arm 48 mounted on an output shaft 47*a* of the pulse motor 47; a rail 49 held on the rotation arm 48; a filler Support body 50 movable in the longitudinal direction along the rail 49; a filler 51 (contact member) mounted on the filler support body 50; an encoder 52 detecting a movement amount of the filler support body 50; and a spring 53 urging the filler support body 50 in one direction. For this encoder 52, it is possible to use a magnetic scale and a linear encoder.

It should be noted that the lens frame shape measurement block 46 can be made as a unitary block with the lens processing apparatus. Alternatively, instead of constituting the lens frame shape measurement block 46 separately from the lens processing apparatus and connecting them electrically, it is possible to employ a configuration in which lens frame shape data measured by the lens frame shape measurement apparatus separate from the lens processing apparatus is input into a floppy disc or IC card and the lens processing apparatus has a reading device for reading data from these media. Another possible configuration is such that lens frame shape data is input from a spectacle frame manufacturer to the lens processing apparatus by on-line.

Moreover, in FIG. 1(A), the filler 51 has a shape like a bead on abacus for measuring the frame (lens frame) shape but the shape is not limited to this. For example, as shown in FIG. 1(B), instead of the filler 51, it is possible to mount a semi-cylindrical filler 51' for lens shape measurement of the rimless frame template (lens shape) 50. These fillers 51 and 51' may be arranged on the filler support body 50. Furthermore, the filler used for the frame (lens frame) shape measurement may have a flat shape instead of the abacus bead. The structure of the fillers 51 and 51' arranged on the filler support body 50 may be such that is disclosed in Japanese Patent Laid-open No. Hei 08-294855. Moreover, the spectacle lens shape measurement apparatus may employ a spectacle lens shape measurement apparatus which is separate from a lens grinder as disclosed in Japanese Patent Laid-open No. Hei 08-294855.

<Control Circuit>

The control circuit has a calculation control circuit 100 (control means). This calculation control circuit 100 is connected to a liquid crystal display block 3, the switch 4*a* for FDP input mode, the switch 4*b* for PD input, the switch 4*c* for bridge width input, the switch 4*d* for lens material selection, the switch for starting measurement, the processing start switch 4*g*, and the ten-key block 5.

Moreover, the calculation control circuit 100 is connected to the rotary encoder 34, the drive controller 101, and the frame data memory 102 The drive controller 101 is connected to motor 7 of the grinding block, the pulse motor 18, the variable motor 31, the pulse motor 45, and a pulse generator 103. The pulse generator 103 is connected to the pulse motor 47 while the encoder 52 of the spectacle lens shape measurement block 46 is connected to the frame data memory 102.

Furthermore, the calculation control circuit 100 is connected to the lens processing data memory 104, the correction table memory (memory for correction data) 105, a reference rotation speed memory 106 for the lens rotation shaft, a shape information memory 107, a shaft-to-shaft distance memory 108, and a difference angle memory 109.

Next, explanation will be given on the function of the calculation control circuit 100.

[1] Calculating the Lens Periphery Processing Data (Lens Shape Data)

(a) Spectacle Lens Shape Measurement

Firstly, a power switch (not depicted) is turned on and the switch 4*e* is operated to set the spectacle lens shape measurement mode. On the other hand, the lid 1*c* is opened and the spectacle lens shape measurement block 46 is pulled out of the apparatus main body 1. A spectacle frame F or a lens-shaped template is set at a predetermined position and the measurement start switch 4*f* is pressed to start measurement.

The calculation controller 100 controls the drive controller 101 causes the pulse generator 106 to generate a drive pulse. This pulse operates the pulse motor 47 and rotate the rotation arm 48. This moves the filler 51 along the inner periphery of the lens frame RF or LP of the spectacle frame F (spectacle frame).

Here, the movement amount of the filler 51 is detected by the encoder 52 and input as a radius vector length $\rho_n$ into the frame data memory 102 (spectacle lens shape data memory) and a pulse identical to the pulse supplied from the pulse generator 106 to the pulse motor 47 is fed as an angle of the rotation arm 48, i.e., radius vector angle $_n\Delta\theta$, to the frame data memory 102. This radius vector $\rho_n$ and the radius vector angle $n\Delta\theta$ are stored as spectacle lens shape data ($\rho_{n,}$ $_n\Delta\theta$, wherein n=0, 1, 2, 3 . . . j) in the frame memory 102. In this embodiment, j is 1,000 and the rotation angle $\Delta\theta$ is $1/1{,}000$ (360 degrees/1,000)=0.36 degrees.

(b) Difference Angle $d\Delta\theta$

Figure 6:
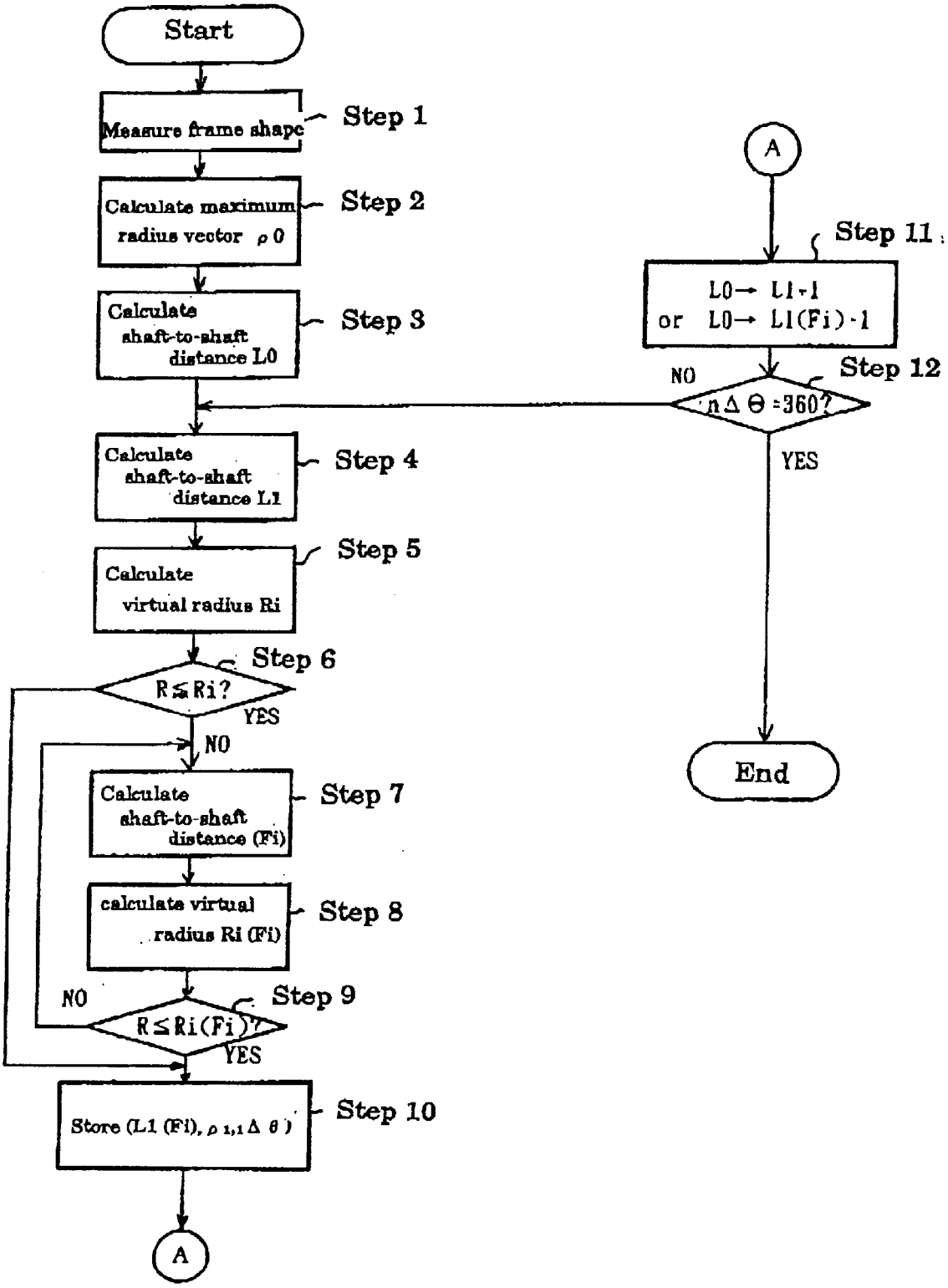
FIG. 6 is s flowchart of processing steps performed by the lens grinding apparatus shown in FIG. 1.

According to the flowchart of FIG. 6, the calculation control circuit 100 calculates a difference angle $d\theta_n$ between a virtual processing point at the radius vector $\rho_n$ of the rotation angle $_n\Delta\theta$ and an actual contact point of the lens (to be processed) with a grindstone at the rotation angle $d\theta_n$ by using the spectacle lens shape data ($\rho_{n,\ n}\Delta\theta$) of the spherical coordinates for lens periphery processing measured at the spectacle lens shape measurement block 46 and radius of curvature R of the grindstone.

<Step 1>

The frame shape measurement block (frame shape measurement apparatus) 46 as the frame shape measurement means calculates the spectacle lens shape of the frame lens frame F or a template processed after the F or a lens model of rimless frame, i.e., radius vector information ($\rho_{n,\ n}\Delta\theta$, wherein n=1, 2, 3, . . . N) and this information is stored in the frame data memory 102.

<Step 2>

According to the radius vector information ($\rho_{n,\ n}\Delta\theta$) from the frame data memory 102, radius vector information ($\rho_{0,\ 0}\Delta\theta$) having the maximum radius vector length $\rho_0$ is found among the information.

<Step 3>

Figure 7:
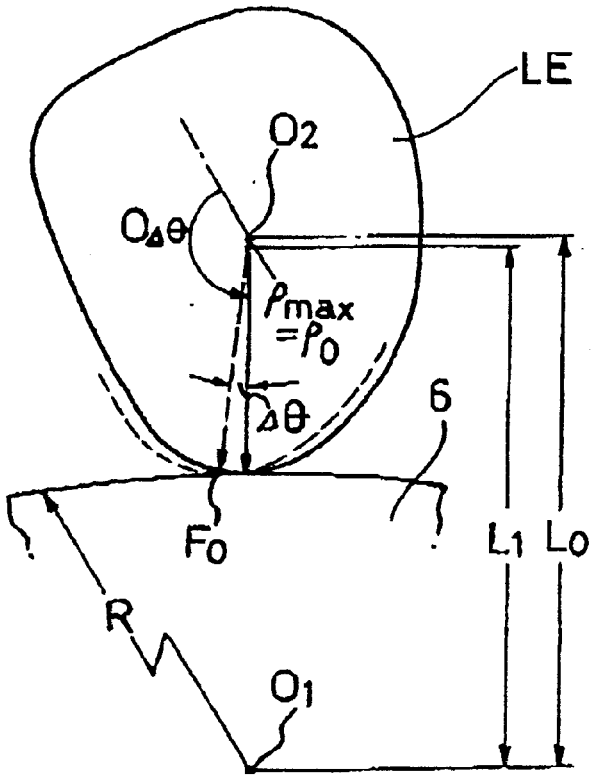
FIG. 7 shows relationship between the radius vector of the spectacle lens and radius of a grindstone for explaining the flowchart of FIG. 6.

The shaft-to-shaft distance $L_0$ between a $O_2$ of the lens rotation shafts 16, 17 and the rotation axis $O_1$ of the grindstone 6 is assumed to be $L_0$ (see FIG. 7). Here, the $L_0$ can be obtained as $L_0=\rho_0+R$ from the known grindstone radius R and the radius vector length $\rho_0$. Furthermore, processing information ($L_{0,\ \rho 0,\ 0}\Delta\theta$) is input and stored in the memory 108.

<Step 4>

Next, when the lens LE is rotated by the unit 0 rotation angle $\Delta\theta$, a shaft-to-shaft distance L1 is calculated at the processing point $F_0$ where the maximum radius vector length $\rho_0$ is in contact with the grindstone 6. Here, the L1 is obtained as follows:

$$L1 = \rho_0 \cdot \cos\Delta\theta + \sqrt{\rho_0^2 \cos\Delta\theta - (\rho^2 - R^2)}$$

<Step 5>

Figure 8:
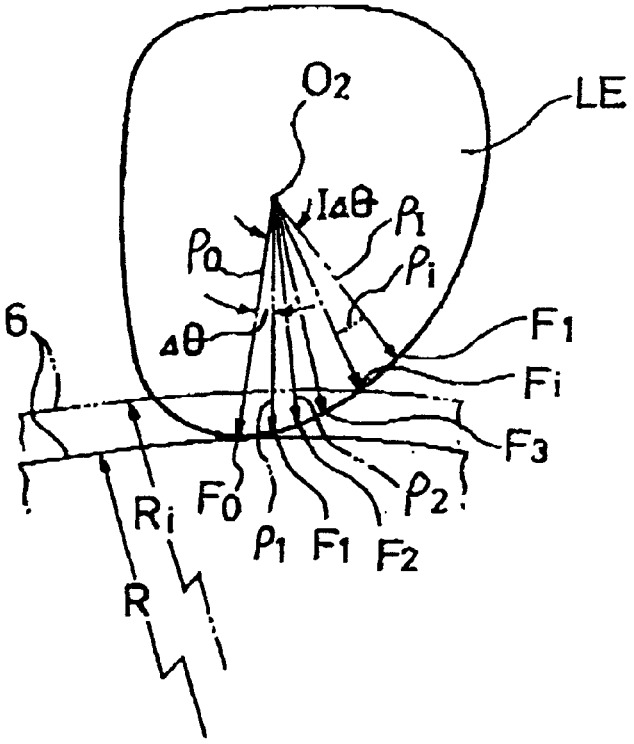
FIG. 8 shows another case showing the relationship between the radius vector of the spectacle lens and radius of the grindstone for explaining the flowchart of FIG. 6

When the maximum radius vector $\rho_0$ is at the processing point $F_0$, the radius vector information ($\rho_{n,\ n}\Delta\theta$) of the frame data memory 102 is used to calculate virtual processing points $F_1$, $F_{2,\ \ldots\ Fi}$, . . . $F_I$) of the first to I-th radius vector information ($\rho_{1,\ 1}\Delta\theta$), ($\rho_{2,\ 2}\Delta\theta$), . . . ($\rho_{1,\ 1}\Delta\theta$) from the maximum radius vector and furthermore, virtual grindstone radius $R_1$, $R_2$, . . . $R_i$, . . . $R_I$ for processing at the respective processing points (see FIG. 8).

<Step 6>

The actual radius R of the grindstone 6 is compared to the radius $R_i$ (i=1, 2, 3, . . . I) obtained in the aforementioned step 5. If R is equal to or smaller than $R_i$, even when lens grinding is performed based on the maximum radius vector ($\rho_{0,\ 0}\Delta\theta$) at the processing point $F_0$, the virtual processing point $F_{ii}$(i=1, 2, 3. . . i, . . . I) of the other radius vectors do not have contact with the grindstone 6, causing no difference angle $d\theta_i$, i.e., no "grindstone interference." The processing information ($L_1$, $\rho_{1,\ 1}\Delta\theta$) at this moment is input and stored to the memory 108 and control is passed to step 11. If $R>R_i$, then control is passed to step 7.

<Step 7>

Figure 9:
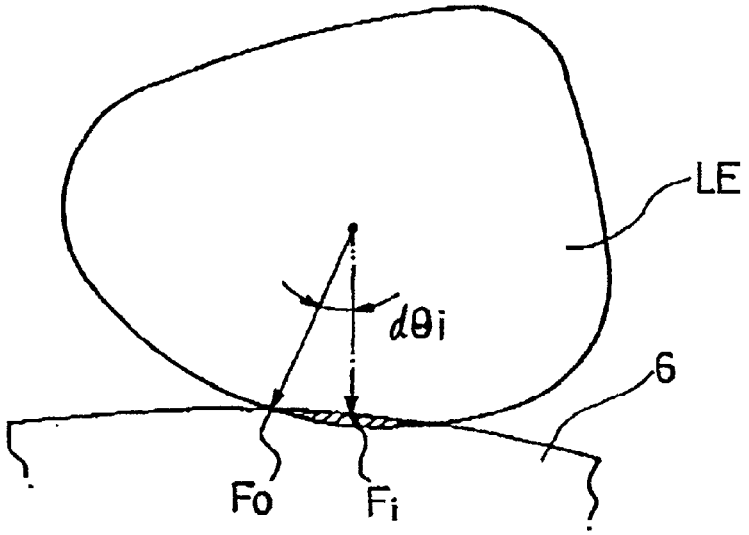
FIG. 9 shows still another case showing the relationship between the radius vector of the spectacle lens and radius of the grindstone for explaining the flowchart of FIG. 6.
Figure 10:
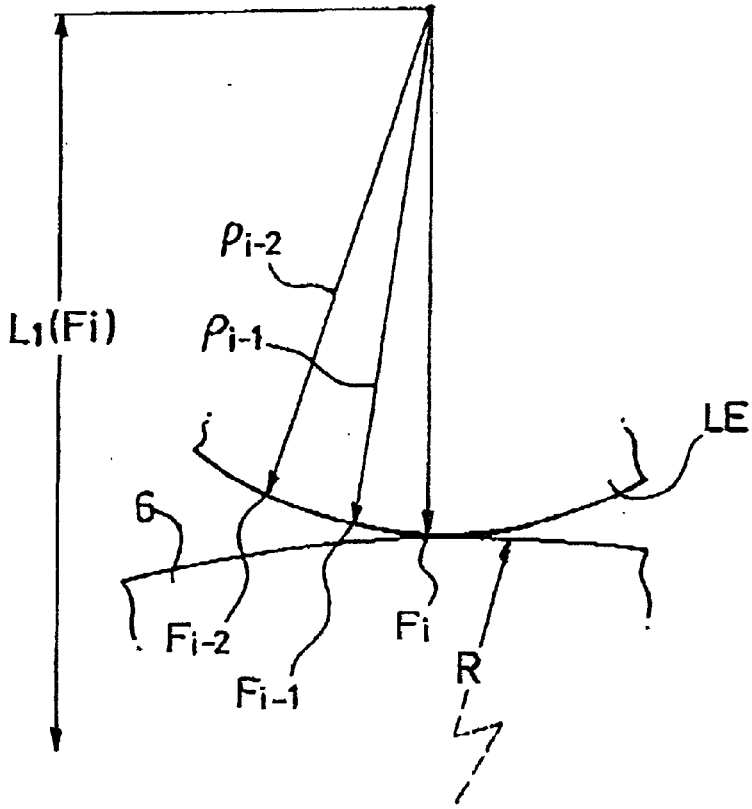
FIG. 10 shows still another case showing the relationship between the radius vector of the spectacle lens and radius of the grindstone for explaining the flowchart of FIG. 6.

If $R>R_i$ in step 6, as shown in FIG. 9, a difference angle $d\theta_i$ is caused by the "grindstone interference" at the virtual processing point $F_i$. In this case, the shaft-to-shaft distance $L_{1\ (Fi)}$ for processing the virtual (interference) processing point Fi with a grindstone having radius R is calculated as follows (see FIG. 10).

$$L_1(Fi) = \rho_i \cos(i\Delta\theta) + \sqrt{\rho_i^2 \cos 2_i \Delta\theta - (\rho_i^2 - R_i^2)}$$

<Step 8>

Based on the processing point $F_i$ processed with the shaft-to-shaft distance $L_1$ ($F_i$) obtained step 7, respective virtual processing points are calculated for the-first to I-th radius vectors in the same way as step 5, and respective virtual grindstone $R_i$ ($F_i$) are obtained.

<Step 9>

In the same way as step 6, the grindstone radius R in case of the shaft-to-shaft distance $L_1$ ($F_i$) is compared to the virtual grindstone radius $R_i$ ($F_i$) of step 8. If R is not smaller than $R_i$ ($F_i$), then control is passed to step 10. If R>Ri (Fi), then control is returned to step 7 to calculate the shaft-to-shaft distance at a new interference point.

<Step 10>

If R is not greater than $R_i$(Fi) in step 9, then processing information (Li(Fi), $\rho_{1,\ 1}\Delta\theta$) is input to and stored in the memory 108.

<Step 11>

In the aforementioned steps 3 to 10, check is made for the radius vector information of ($\rho_{1,\ 1}\Delta\theta$) whether the "grindstone interference" is generated and if the grindstone interference is caused, that part is eliminated Thus, it is possible to obtain processing information (Li, $\rho_1$, $_1\Delta\theta$) or (Li (Fi), $\rho_{1,\ 1}\Delta\theta$) not causing grindstone interference. Subsequently, steps 3 to 10 are executed for the next radius vector ($\rho_{2,\ 2}$ θ) and all of the remaining radius vectors.

<Step 12>

For $_n\Delta\theta$=360 degrees, i.e., for all the radius vector information, the aforementioned check is made whether a difference angle $d\theta_n$(n=0, 1, 2, 3, . . . I, . . . I) is caused by the grindstone interference. When it is determined that the grindstone interference does occur, it is determined whether processing information ($L_n$, $\rho_{n,\ n}\Delta\theta$) not causing the grindstone interference is obtained. The processing information ($L_n$, $\rho_{n,\ n}\Delta\theta$) thus obtained is stored in the memory 108.

Moreover, the calculation control circuit 100 calculates the difference angle $d\theta_n$ a when calculating the processing information ($L_n$, $\rho_{n,\ n}\Delta\theta$) and stores the obtained difference angle $d\theta_n$ as the processing information ($L_n$, $d\theta_n$, $\rho_{n,\ n}\Delta\theta$) in a difference angle memory 109.

(2) Shaft-to-shaft Distance At Contact Angle $\tau_n$ (a) Shaft-to-shaft Distance In the conventional ρL (radius vector ρ–shaft-to-shaft distance L) conversion method, as shown in FIG. 11 and FIG. 12, calculation is executed to obtain a shaft-to-shaft distance Ln between the grindstone 6 and the lens LE to be processed when the radius vector for the angle $\theta_i = {}_n\Delta\theta$ is $\rho_n$. When a difference angle $d\theta_n$ is present, the contact position between the grindstone 6 and the lens LE to be processed is shifted from $\theta_i = d\theta_n$ by a difference angle $d\theta_n$ and the radius vector of the contact position becomes $\rho_j$. In this case, the calculated shaft-to-shaft distance Ln at the angle $_n\Delta\theta$ has an error ΔL against the actual shaft-to-shaft distance Li'. When $\rho_n$ is assumed to be the radius vector at the contact angle $\tau_n$ if the difference angle $d\theta_n$ is present at angle $_n\Delta\theta$, the actual shaft-to-shaft distance Ln' where the lens LE is to be processed by the grindstone 6 is obtained as follows:

$$L_n' = L_n + \Delta L$$

(b) Speed Control at the Contact Angle $\tau_n$

By using the difference angle $d\theta_n$ thus obtained, the calculation control circuit 100 controls operation of the pulse motor 18 so as to perform rotation speed control of a circular spectacle lens LE to be processed as will be explained below.

Calculation of the Contact Angle $\tau_n$

As has been described above, when it is assumed that the spectacle lens LE to be processed is in contact with the grindstone 6 at angle $_n\Delta\theta$ with a difference angle $d\theta_n$, the actual contact angle $\tau_n$ of the spectacle lens LE with grindstone 6 is calculated as follows:

$$\tau_n = {}_n\Delta\theta + d\theta_n$$

This contact angle $\tau_n$ obtained is stored as processing information ($L_n$, $\tau_n$, $\rho_{n,\ n}\Delta\theta$ in Spherical coordinates into the memory 105.

Here, Tr is assumed to be a time of one turn of the lens rotation shaft together with the lens to be processed while the rotation angular speed is constant (Sr) and Ts is assumed to be a time of one turn of the lens rotation shaft together with the lens to be processed while the contact speed is constant (Ss) without change of the contact angle. When the lens is rotated at a speed defined by the speeds Sr and Ss, the rotation speed St is calculated as follows:

$$1/St = 1/Sr + 1Ss$$

and the total time for one turn is obtained as follows:

$Tt=Tr+Ts$

Accordingly, by changing the ratio of the constant rotation angular speed against the constant contact angle, it is possible to enhance the speed component of the contact angle for stabilizing the contact without changing the total time of one turn.

This ratio as a constant angular speed component should be set not greater than the maximum rotation speed of Sr or Ss that can mechanically be obtained. This is because the contact angle speed may partially become 0 and the contact angle speed component can be set unconditionally.

By increasing the speed component ratio of the contact angle, it is possible to improve the stability of the contact.

The speed component ratio of the rotation angle and the contact angle may be set according to the difference in the processing conditions. One example is given below.

Rotation Angular Speed Component: Contact Angular Speed Component (Time Ratio)

| Lens material | Rough processing | Finishing | Mirror processing | Grooving | Chamfering | Mirror chamfering |
|---|---|---|---|---|---|---|
| Glass | 10:0 | 5:5 | 5:5 | 5:5 | 4:6 | 4:6 |
| CR-39 | 8:2 | 4:6 | 4:6 | 5:5 | 3:7 | 3:7 |
| High index | 7:3 | 3:7 | 2:8 | 5:5 | 3:7 | 2:8 |
| Poly-carbonate | 8:2 | 3:7 | 2:8 | 5:5 | 3:7 | 2:8 |
| Acrylic | 8:2 | 3:7 | 2:8 | 5:5 | 3:7 | 2:8 |

For example, when performing finishing of CR-39, since the speed component ratio is 4:6, the rotation speed for determining the speed is set to the ratio of 4:6. In this case, if the total one turn time is 10 s, the rotation angular speed component is 4 s and the contact angular speed component is 6 s. This is used together with respective change amounts of the ${}_n\Delta\theta$ and $\tau_n$, so as to determine the speed of that portion.

When the number of divisions is 1000, the number of data items is also 1000. Here, as has been described above, the time allocated for respective angular speed components are 4 s for the rotation angular speed component and 6 s for the contact angular speed component. The component 4 s divided by the aforementioned divider is $4/1000$ and the component 6 s divided by the divider is $6/1000$. Accordingly, the rotation angular speed is determined to be a value obtained by dividing respective data change amounts by $4/1000$ while the contact angular speed is determined to be a value obtained by dividing respective data change amounts by $6/1000$.

Rotation angular speed$=({}_2\Delta\theta-{}_1\Delta\theta)/(4/1000)=({}_2\Delta\theta-{}_1\Delta\theta)/0.004$ Contact angular speed$=(\tau_2-\tau_1)/(6/1000)=(\tau_2-\tau_1)/0.006$ This is one example, and-values for the other points are calculated in the same way.

A has been described above, in the lens grinding method of the present invention, the rotation speed of the spectacle lens to be ground is changed according to the spectacle frame lens shape information, spectacle lens information such as spectacle lens material, various spectacle processing information required for processing a spectacle lens.

Moreover, in the lens grinding method of this invention, a predetermined angle for the rotation reference position when the spectacle frame lens shape is expressed in spherical coordinates is referred to as a rotation angle, and an angle for the rotation reference position when the lens shape in contact with the grindstone is expressed in spherical coordinates is referred to as a contact angle. Calculation is performed to obtain a rotation angle change of the lens rotation shaft holding the spectacle lens per a predetermined time as a rotation angular speed and a contact angle change per a predetermined time as a contact angular speed. The rotation speed of the lens rotation shaft is controlled by the speed obtained by combining the speed component in which the rotation angle rotates at a constant speed and the speed component in which the contact angle rotates at a constant speed.

Furthermore, in the lens grinding method of this invention, a predetermined angle for the rotation reference position when the spectacle frame lens shape is expressed in spherical coordinates is referred to as a rotation angle, and an angle for the rotation reference position when the lens shape in contact with the grindstone is expressed in spherical coordinates is referred to as a contact angle. Calculation is performed to obtain a rotation angle change of the lens rotation shaft holding the spectacle lens per a predetermined time as a rotation angular speed and a contact angle change per a predetermined time as a contact angular speed The rotation speed of the lens rotation shaft can change with an arbitrary combination ratio of the speed component in which the rotation angle rotates at a constant speed and the speed component in which the contact angle rotates at a constant speed.

Moreover, the lens grinding apparatus according to the present invention includes: a lens rotation shaft for sandwiching and rotating a spectacle lens; drive means for driving the lens rotation shaft; a grindstone for grinding a spectacle lens; and shaft-to-shaft distance adjusting means for controlling a distance between a lens rotation shaft and a grindstone. The lens grinding apparatus further includes calculation control means which operates as follows. A predetermined angle for the rotation reference position when the spectacle frame lens shape is expressed in spherical coordinates is referred to as a rotation angle, and an angle for the rotation reference position when the lens shape in contact with the grindstone is expressed in spherical coordinates is referred to as a contact angle. Calculation is performed to obtain a rotation angle change of the lens rotation shaft holding the spectacle lens per a predetermined time as a rotation angular speed and a contact angle change per a predetermined time as a contact angular speed. The rotation speed of the lens rotation shaft is controlled by the speed obtained by combining the speed component in which the rotation angle rotates at a constant speed and tie speed component in which the contact angle rotates at a constant speed.

Furthermore, the lens grinding apparatus according to the present invention includes: a lens rotation shaft for sandwiching and rotating a spectacle lens; drive means for driving the lens rotation shaft; a grindstone for grinding a spectacle lens; and shaft-to-shaft distance adjusting means for controlling a distance between a lens rotation shaft and a grindstone. The lens grinding apparatus further includes calculation control means which operates as follows. A predetermined angle for the rotation reference position when the spectacle frame lens shape is expressed in spherical coordinates is referred to as a rotation angle, and an angle for the rotation reference position when the lens shape in contact with the grindstone is expressed in spherical coordinates is referred to as a contact angle. Calculation is performed to obtain a rotation angle change of the lens rotation shaft holding the spectacle lens per a predetermined time as a rotation angular speed and a contact angle change per a predetermined time as a contact angular speed. The rotation speed of the lens rotation shaft can change with an arbitrary combination ratio of the speed component in which the rotation angle rotates at a constant seed and the speed component in which the contact angle rotates at a constant speed.

In the aforementioned lens grinding method and apparatus of the present invention, it is possible to apply a rotation speed stabilizing the grinding time at each of the points and further to change the stabilization degree of the rotation speed at each of the points.

What is claimed is:

1. A lens grinding apparatus comprising:

a lens rotation shaft for sandwiching and rotating a spectacle lens;

drive means for driving the lens rotation shaft;

a grindstone for grinding a spectacle lens;

shaft-to-shaft distance adjusting means for controlling a distance between a lens rotation shaft and a grindstone; and calculation control means for controlling a rotation speed of the lens rotation shaft, wherein the calculation control means operates in such a manner that a predetermined angle for the rotation reference position when the spectacle frame lens shape is expressed in spherical coordinates is referred to as a rotation angle while an angle for the rotation reference position when the lens shape in contact with the grindstone is expressed in spherical coordinates is referred to as a contact angle and calculation is performed to obtain a rotation angle change of the lens rotation shaft holding the spectacle lens per a predetermined time as a rotation angular speed and a contact angle change per a predetermined time as a contact angular speed, so that the rotation speed of the lens rotation shaft can change with an arbitrary combination ratio of the speed component in which the rotation angle rotates at a constant speed and the speed component in which the contact angle rotates at a constant speed.

2. A lens grinding method comprising the steps of:

adopting a predetermined angle for a rotation reference position when a spectacle frame lens shape is expressed in spherical coordinates as a rotation angle;

adopting an angle for the rotation reference position when the lens shape in contact with a grindstone is expressed in spherical coordinates as a contact angle;

obtaining a rotation angle change of a lens rotation shaft holding a spectacle lens per a predetermined time as a rotation angular speed;

obtaining a contact angle change per a predetermined time as a contact angular speed; and controlling rotation speed of the lens rotation shaft so as to be changed in accordance with a spectacle frame lens shape by the speed obtained by combining the speed component in which the rotation angle rotates at a constant speed and the speed component in which the contact angle rotates at a constant speed.

3. A lens grinding method according to claim 2, wherein the rotation speed of the lens rotation shaft can change with an arbitrary combination ratio of the speed component in which the rotation angle rotates at a constant speed and the speed component in which the contact angle rotates at a constant speed.

4. A lens grinding apparatus comprising:

a lens rotation shaft for sandwiching and rotating a spectacle lens;

drive means for driving the lens rotation shaft;

a grindstone for grinding a spectacle lens;

shaft-to-shaft distance adjusting means for controlling a distance between a lens rotation shaft and a grindstone; and calculation control means for controlling a rotation speed of the lens rotation shaft, wherein the calculation control means operates in such a manner that a predetermined angle for the rotation reference position when the spectacle frame lens shape is expressed in spherical coordinates is referred to as a rotation angle while an angle for the rotation reference position when the lens shape in contact with the grindstone is expressed in spherical coordinates is referred to as a contact angle and calculation is performed to obtain a rotation angle change of the lens rotation shaft holding the spectacle lens per a predetermined time as a rotation angular speed and a contact angle change per a predetermined time as a contact angular speed, so that the rotation speed of the lens rotation shaft is controlled so as to be changed in accordance with a spectacle frame lens shape by the speed obtained by combining the speed component in which the rotation angle rotates at a constant speed and the speed component in which the contact angle rotates at a constant speed.

* * * * *